US011439186B2

(12) United States Patent
Ouyang

(10) Patent No.: US 11,439,186 B2
(45) Date of Patent: Sep. 13, 2022

(54) ATOMIZER AND AN ELECTRONIC CIGARETTE CONTAINING THE SAME

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 233 days.

(21) Appl. No.: 16/884,181

(22) Filed: May 27, 2020

(65) Prior Publication Data

US 2020/0375250 A1 Dec. 3, 2020

(30) Foreign Application Priority Data

Jun. 3, 2019 (CN) ..... 201910475116.3

(51) Int. Cl.
*A24F 40/42* (2020.01)
*A24F 40/10* (2020.01)

(52) U.S. Cl.
CPC ..... *A24F 40/42* (2020.01); *A24F 40/10* (2020.01)

(58) Field of Classification Search
CPC ..... A24F 40/40; A24F 40/42; A24F 40/10
See application file for complete search history.

(56) References Cited

U.S. PATENT DOCUMENTS

2018/0098578 A1 4/2018 Monsees et al.

FOREIGN PATENT DOCUMENTS

| | | | | |
|---|---|---|---|---|
| CN | 208300942 | U | | 1/2019 |
| CN | 208676368 | U | | 4/2019 |
| JP | 2015529458 | A1 | * | 10/2015 |
| WO | 2007101608 | A1 | * | 9/2007 |
| WO | 2017167932 | | * | 10/2017 |
| WO | 2017167932 | A1 | * | 10/2017 |
| WO | 2018/130068 | A1 | | 7/2018 |
| WO | 2018/141106 | A1 | | 8/2018 |

OTHER PUBLICATIONS

European Patent Office, Search Report and Search Opinion, European Patent Application No. 20177731.5, 9 pages, dated Nov. 10, 2020.

* cited by examiner

*Primary Examiner* — Jean F Duverne
(74) *Attorney, Agent, or Firm* — Thompson Hine LLP

(57) ABSTRACT

The present disclosure provides an atomizing device and an electronic cigarette using this atomizing device, wherein the atomizing device includes a main body and a nozzle cover, the main body includes a first part and a second part; the first part is covered by the nozzle cover, and the second part of the main body is used to insert the power supply device. When the main body is inserted into the power supply device, the main body further includes a third part exposed out of the power supply device, and the third part is further provided with at least one buckle part. The technical scheme of present disclosure can effectively facilitate the user to plug in/out the atomizing device and effectively prevent the nozzle cover from detaching from the main body.

13 Claims, 3 Drawing Sheets

ATOMIZER AND AN ELECTRONIC CIGARETTE CONTAINING THE SAME

CROSS-REFERENCE TO RELATED APPLICATION

This application claims priority to Chinese Patent Application No. 201910475116.3, filed on Jun. 3, 2019. The disclosure of the foregoing application is incorporated herein by reference in its entirety.

TECHNICAL FIELD

The present disclosure relates to an atomizing device and an electronic cigarette using the atomizing device.

BACKGROUND

Electronic cigarette, also known as E-cigarettes, is mainly used to quit smoking and replace traditional cigarettes. It has similar appearance and similar taste as traditional cigarettes, and even has more flavors than traditional cigarettes. It can also make smoke and taste, even make you feel high just like traditional cigarettes. Because electronic cigarette does not have tar, suspended particles, and other harmful components contained in traditional cigarettes, it is gradually replacing traditional cigarettes in the market. Because small electronic cigarettes are easy to carry, it is getting popular among consumers.

However, the atomization device of traditional small cigarette is usually plugged into the power supply device of electronic cigarette. When filling oil, user usually hold the nozzle cover buckled to the main body of atomizing device and pull out the entire atomizing device, it is hard to apply force. In addition, since the main force bear point is the connection slot buckle-connecting with the nozzle cover and the main body of atomizing device, the action of plugging in/out for a long time tends to break the connection slot, resulting in the detachment of nozzle cover from the main body.

SUMMARY

The main purpose of present disclosure is to provide an atomizing device of electronic cigarette, facilitating the user to plug in/out the atomizing device and effectively preventing the nozzle cover from detaching itself from the main body.

In order to achieve the above object, an atomizing device of electronic cigarette provided in the present disclosure includes a main body and a nozzle cover; said main body includes a first part, a second part, and a third part. Said first part is covered by said nozzle cover, and said second part of main body can be inserted into the power supply device. When said main body is inserted into said power supply device, said third part will be exposed outside, and it is further provided with at least one buckle part.

Preferably, the main body is convexly provided with at least one limiting block on said second part. When said main body is inserted into said power supply device, said limiting block will abuts against the outer edge of said power supply device, and the surface of said limiting block facing away from said second part will be exposed to form said third part.

Preferably, the outer surface of limiting block protrudes beyond the outer surface of said power supply device to form said buckle part.

Preferably, the outer surface of limiting block is lower than or flush with the outer surface of said power supply device, and said limiting block is provided with an groove abutted by finger of user, forming said buckle part.

Preferably, the main body is provided with a chamber for storing tobacco juice. The wall of said groove right facing towards the notch is a transparent area, and said transparent area is used for user to check the tobacco juice stored in the chamber.

Preferably, said power supply device is provided with an avoidance groove matching the side structure of said limiting block. When said second end of main body is inserted into said power supply device, said limiting block will locate in said avoidance groove.

Preferably, one end of said limiting block away from said nozzle cover is in arc-shape, and said avoidance groove is in corresponding arc-shape.

Preferably, the nozzle cover is provided with a notch matching the side structure of said limiting block, and said limiting block partially locate in said notch.

Preferably, one end of said limiting block away from said nozzle cover is in arc-shape, and said avoidance groove is in corresponding arc-shape.

Preferably, two opposite ends of said nozzle cover are provided with connection card slots, and the main body is correspondingly provided with two connecting clips, so that said nozzle cover can buckle-connect with said main body as well as cover said first part.

Two opposite surfaces of said second part of main body are convexly provided with said limiting blocks, and said two limiting blocks form said third part; said two limiting blocks and said two connecting clips locate on each adjacent outer surface of said main body respectively.

Preferably, said main body includes a long axis and a short axis; said two connecting clips are oppositely provided on the two outer surfaces of side main body along the direction of long axis, and said two limiting blocks are oppositely provided on the two outer surfaces of side main body along the direction of short axis.

The present disclosure further provides an electronic cigarette, including a power supply device and an atomizing device; wherein, said atomizing device includes a main body and a nozzle cover; said main body includes a first part, a second part, and a third part. Said first part is covered by nozzle cover; said second part is inserted into the power supply device of electronic cigarette; said third part is exposed outside when said main body is inserted into said power supply device, and said third part is further provided with at least one buckle part.

In the atomizing device in the technical solution of the present disclosure, the main body is divided into a first part, a second part, and a third part. When the nozzle cover is installed on said main body, the first part of main body will be covered; when the main body is inserted into the power supply device, the second part will be covered by the power supply device, and the third part is exposed from the power supply device; the third part is provided with a buckle part for user to hold. When plugging out the atomizing device, the user applies a force on the buckle to pull out the atomizing device. Since the main force bearing point is the main body, and the nozzle cover is fixed on the main body to be exposed outside without any interaction with other parts, the nozzle cover won't bear the external force during entire process of plugging in/out, effectively avoiding the detachment of the nozzle cover from the main body; in addition, the buckle part makes it easier for users to plug out the atomization device.

DESCRIPTION OF DRAWINGS

In order to more clearly explain the technical solutions in the embodiments of this present disclosure or the prior art, drawings used in the description of embodiments or the prior art are briefly introduced as below.

Obviously, drawings in the following description are only used for some embodiments of this present disclosure. For those of ordinary skill in the art, other drawings can be obtained according to the structure shown in these drawings without any creative effort.

DESCRIPTION OF DRAWING LABELS

Figure 1:
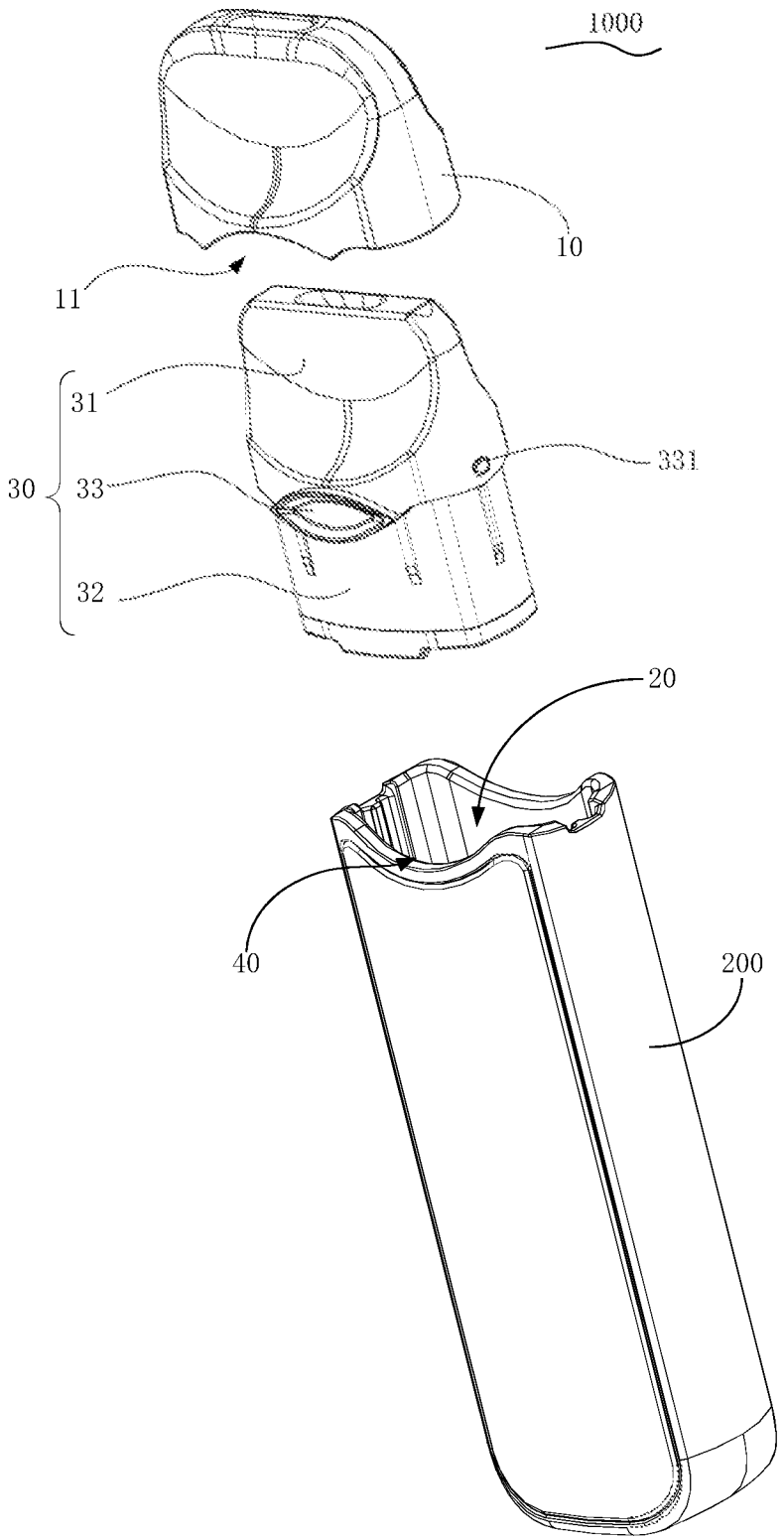
FIG. 1 is an exploded view of connection structure in electronic cigarette described in this present disclosure.

| Label | name |
|---|---|
| 100 | Atomizing device |
| 10 | Nozzle cover |
| 11 | Notch |
| 30 | Main body |
| 31 | First part |
| 32 | Second part |
| 33 | Third part |
| 331 | Buckle part |
| 331' | Limiting block |
| 332' | Groove |
| 34 | Connection buckle |
| 200 | Power supply device |
| 20 | Installation space |
| 40 | Avoidance groove |
| 1000 | Electronic cigarette |

The purpose, functional characteristics, and advantages of the present disclosure will be further explained with the reference to embodiments and drawings.

DETAILED DESCRIPTION

The technical solutions in the embodiments of present disclosure will be clearly and completely described as below with reference to drawings in the embodiments of present disclosure. Obviously, any described embodiment is only a part of embodiments of this present disclosure, but not all of them. Based on the embodiments of present disclosure, any other embodiment obtained by a person of ordinary skill in the art without any creative efforts shall be within the protection scope of this present disclosure.

It should be noted that any directional indication (such as up, down, left, right, front, and back . . . ) in the embodiment of present disclosure is only used to explain the relative positional relationship and movement of components in a specific posture (as shown in drawings). If such specific posture changes, the directional indication will change accordingly.

In addition, the descriptions related to "first", "second", etc. in the present disclosure are for descriptive purposes only, and cannot be understood as any indication or implication of its relative importance or implicit indication of the number of technical features. Therefore, any feature defined as "first" or "second" may explicitly or implicitly include at least one of features. In addition, any technical solutions in various embodiments can be combined with each other but must be realized by a person of ordinary skill in the art. When such combination of technical solutions shows conflicts or cannot be achieved, it should be considered as nonexistent and will not be within the protection scope claimed by this present disclosure.

In the present disclosure, the terms of "connected" and "fixed" shall be understood in a broad sense unless otherwise specified and defined; for example, "fixed" may be a fixed connection, a detachable connection, or an integral one; It can be a mechanical connection or an electrical connection; it also can be directly connected or indirectly connected through an intermediate medium; it also can be an internal connection of two elements or an interaction relationship between two elements, unless it is clearly defined otherwise. For those of ordinary skill in the art, they can explain specific meanings of above terms in the present disclosure according to the specific situation.

The present disclosure provides an electronic cigarette 1000. Said electronic cigarette 1000 includes an atomizing device 100 and an power supply device 200; said power supply device 200 is provided with a power supply and a control center, and the power supply device 200 is further provided with an installation space 20 for the atomizing device 100 to partially plug in. When said atomizing device 100 is partially inserted in said installation space 20, the contact electrode of atomizing device 100 will electrically connect to the output electrode of said power supply device 200. Driven by the power supply device 200, the atomizing device 100 will heat the stored tobacco juice to generate smoke sucked by smokers.

Figure 2:
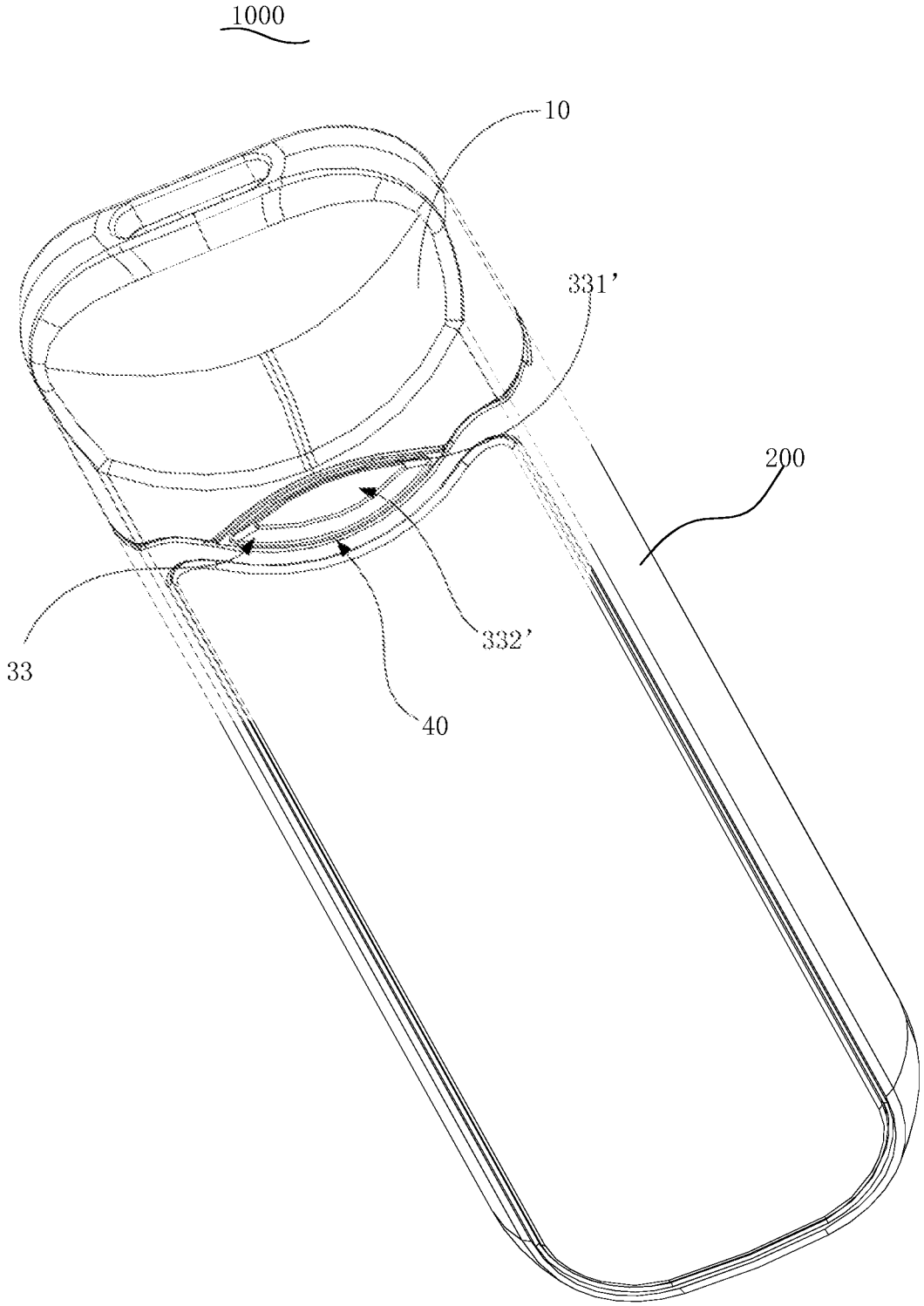
FIG. 2 is a schematic sectional view of a connection structure in the electronic cigarette described in this present disclosure.
Figure 3:
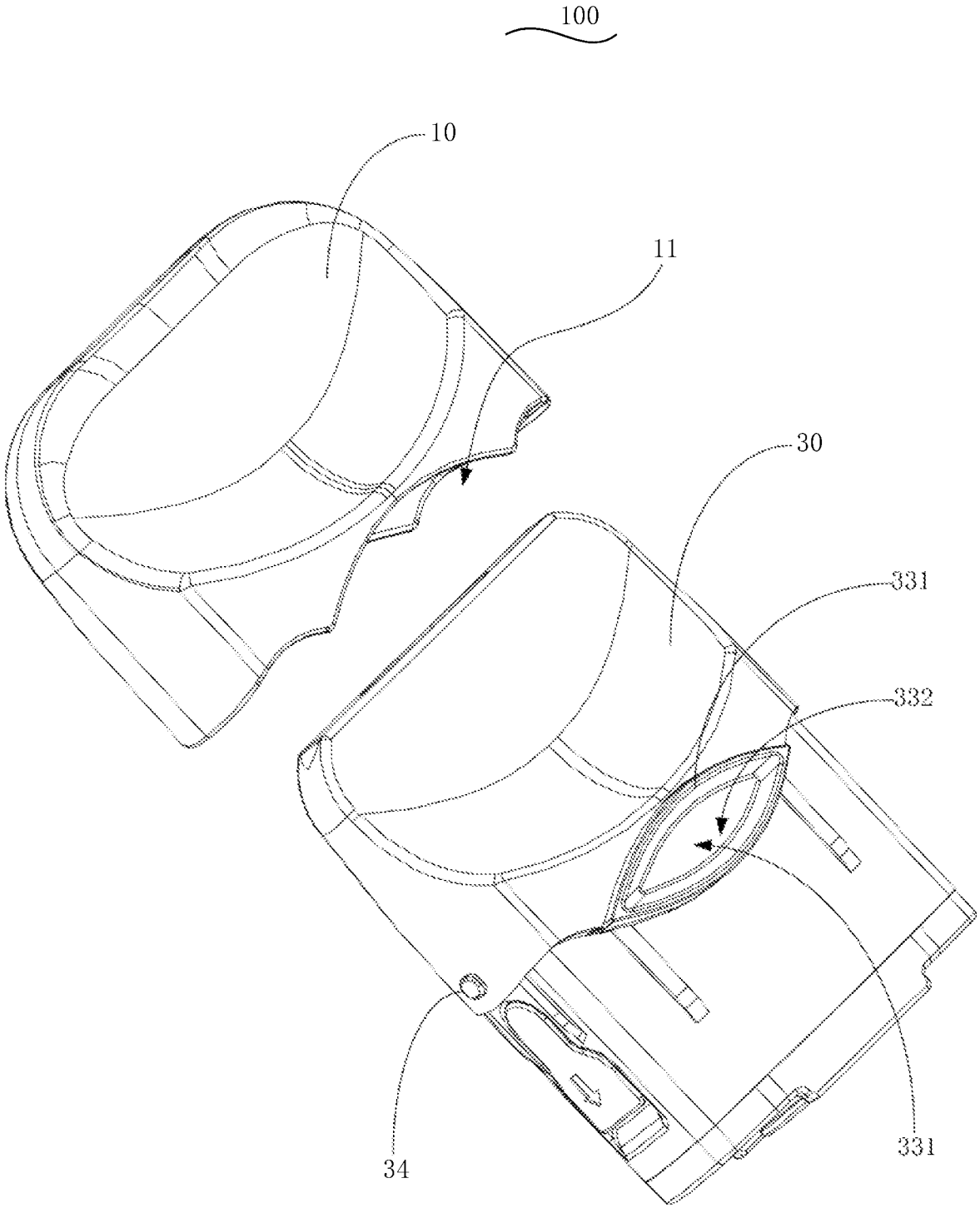
FIG. 3 is an exploded view of connection structure in the atomizing device described in this present disclosure.

As shown in FIG. 1 to FIG. 3, in the embodiment of present disclosure, the atomizing device 100 includes a nozzle cover 10 and a main body 30; said nozzle cover 10 buckle-connects to one end of main body 30 and is provided with a suction port communicating with the air channel inside the main body 30; one end of said main body 30 away from the nozzle cover 10 is provided with a contact electrode to electrically connect with internal heating elements and power supply device 200. Said main body 30 includes a first part 31, a second part 32, and a third part 33. Said nozzle cover 10 will cover said first part 31 when buckle-connects to the main body 30. Said second part 32 is used to insert into said installation space 20. Said third part 33 is exposed from said power supply device 200 and provided with a buckle part for users to plug in/out the atomization device 100.

In the atomizing device 100 in the technical solution of the present disclosure, the main body 30 is divided into a first part 31, a second part 32, and a third part 33. When the nozzle cover 10 is installed on said main body 30, the first part 31 of main body 30 will be covered; when the main body 30 is inserted into the power supply device 200, said second part 32 will be covered by the power supply device 200, and the third part 33 will be exposed from the power supply device 200; the third part is provided with a buckle part for user to hold. When plugging out the atomizing device 100, the user applies a force on the buckle part to pull out the atomizing device 100. Since the main force bearing point is the main body 30, and the nozzle cover 10 is fixed on the main body 30 to be exposed outside without any interaction with other parts, the nozzle cover 10 won't bear the external force during entire process of plugging in/out, effectively avoiding the detachment of the nozzle cover 10 from the main body 30. In addition, the buckle part make it easier for users to plug out the atomization device 100.

Specifically, as shown in FIG. 2, in the embodiment of present disclosure, said main body 30 is provided with a limiting block 331' on said second part 32. When said second part 32 of main body 30 is inserted into the power supply device 200, said limiting block 331' will abuts against the outer edge of said power supply device 200 and be exposed to the outside of said power supply device 200 to form said third part 33. Wherein, said main body is provided with the limiting block 331' on its second part 32 to form the third part 33; since the effective thickness of part three 33 is relatively large, with higher connection strength, it can effectively prevent the user from crushing the surface of main body 30. At the same time, when the second part 32 of main body is inserted into said installation space 20, said limiting block 331' will abut against the outer edge of said power supply device 200 to effectively prevent internal components of power supply device 200 from damaging due to excessive insertion.

Specifically, the outer surface of limiting block 331' protrudes beyond the outer surface of said power supply device 200 to form said buckle part. Wherein, in this embodiment, the size of said limiting block 331' along the circumferential direction of said main body 30 is larger and the size of said limiting block along axial direction of said main body 30 is smaller, which make the transition area between the atomizing device 100 and the power supply device 200 smaller, so that the limiting block 331' can protrude from the power supply device 200 to form said buckle part; when plugging out the atomizing device 100, users will only need to apply force with their fingers on the side of the limiting block 331' away from the nozzle cover 10 for plugging it out.

It can be understood that, in practical applications, it is not limited to use above-mentioned method that the outer surface of limiting block 331' protrudes beyond the outer surface of said power supply device 200 to form said buckle part. For example, in another embodiment of the disclosure, the outer surface of limiting block 331' is lower than or flush with the outer surface of said power supply device 200, and said limiting block 331' is provided with an groove 332' abutted by user's finger, forming said buckle part. When disassembling the atomizing device 100, users will only need to abut their fingertips against the wall of groove 332' near said nozzle cover 10 to apply force to plug out the atomizing device 100. This method is also within the protection scope of present disclosure.

Furthermore, in this embodiment, said main body 30 is semi-transparent; because it is provided with a groove 332', and the thickness of groove 332' is relatively thin, a transparent area can be formed. With reasonable design on its internal structure, this transparent area will directly faces the chamber of main body 30 storing tobacco juice, so that users can check the residual amount of tobacco juice stored inside the chamber to effectively prevent insufficient residual of tobacco juice and dry boiling.

It can be understood that, in practical applications, it is not limited for the main body 30 to choose above-mentioned semi-transparent style. For example, said main body 30 can be directly provided with a transparent element for checking the residual amount of tobacco juice, which is also within the protection scope of present disclosure.

Furthermore, as shown in FIG. 1 to FIG. 3, because said limit block 331' is provided with the groove 332', the size of limiting block 331' will be larger. Therefore, in this embodiment, the power supply device 200 is provided with an avoidance groove 40 matching the side structure of said limiting block 331'. When said second end of main body 30 is inserted into said power supply device 200, said limiting block 331' will locate in said avoidance groove 40. This avoidance groove 40 with the limiting block 331' can effectively improve the big space of parting surfaces between the atomizing device 100 and the power supply device 200 due to the big size of the limiting block 331'.

Furthermore, as shown in FIG. 1 or FIG. 3, in the embodiment of present disclosure, one end of limiting block 331' away from said nozzle cover 10 is in arc-shape, and said avoidance groove 40 is in corresponding arc-shape. Wherein, in this embodiment, one end of said limiting block 331' away from said nozzle cover is in arc-shape, and said avoidance groove 40 provided on the nozzle cover 10 is in corresponding arc-shape. When the limiting block 331' locates in the avoidance groove 40, its small end will be inserted into the big end of avoidance groove 40 first for guiding to make the installation effective and easier. It further prevents the fitting structure of straight openings, such as rectangles, from abut-connecting during installation.

Of course, in practical applications, it is not only limited for said limiting block 331' and said avoidance groove 40 to be the arc-shape; any shape with both large and small openings, such as diamond shape and trapezoidal shape, is also within the protection scope of present disclosure.

Similarly, in practical applications, it is not limited to use the avoidance groove 40 provided in the power supply device 200 to contain the limiting block 331'. For example, as shown in FIG. 1 or FIG. 3, in other embodiments of present disclosure, the nozzle cover 10 can be provided with a notch 11 matching the side structure of said limiting block 331', and said limiting block 331' partially locates in said notch 11. This method is also within the protection scope of present disclosure.

Similarly, the beneficial effect shown in such matching arc-shaped surface of said limiting block 331' and said notch 11 is the same as the above, so it will not be elaborated further herein.

Therefore, preferably, as shown in FIG. 1, in the embodiment of present disclosure, both said power supply device 200 and said nozzle cover 10 are provided with containing structures corresponding to the sides of said limit block 331'. In addition, one part of said limiting block 331' locates in the notch 11, and another part locates in the avoidance groove 40, so that it is unnecessary to provide larger-sized notch 11 or avoidance groove 40, resulting in lower connection strength. At the same time, the matching between said limiting block 331' and the avoidance groove 40/notch 11 has an effect of positioning, which will effectively prevent shaking among the nozzle cover 10, the power supply device 200, and the main body 30.

Specifically, as shown in FIG. 1 or FIG. 3, in the embodiment of present disclosure, the opposite ends of nozzle cover 10 are provided with connection card slot; said main body 30 is correspondingly provided with two connecting clips 34 to make said nozzle cover 10 buckle-connect to said main body 30 and cover said first part 31. The opposite surfaces of said second part 32 of main body 30 are convexly provided with said limiting blocks 331', and said two limiting blocks 331' form said third part 33; said two limiting blocks 331' and said two connecting clips 34 locate on each adjacent outer surface of said main body 30 respectively. The main body includes a long axis and a short axis; said two connecting clips 34 are oppositely provided on the two outer surfaces of side main body 30 along the direction of long axis, and said two limiting blocks 331' are oppositely provided on the two outer surfaces of side main body 30 along the direction of short axis. Specifically, in this embodiment, the surfaces of said connection card slot and said limit block 331' are staggered for effectively saving installation space. At the same time, the two connecting clips 34 are provided along the direction of long axis of main body 30 to make the nozzle cover 10 hard to warp. At the same time, the limiting blocks 331' are provided along the direction of short axis of main body 30; when the user holds these two limiting blocks 331', the distance between fingers will be short, saving more strength.

The present disclosure further provides an electronic cigarette 1000. Said electronic cigarette 1000 includes a power supply device 200 and an atomizing device 100. The specific structure of this atomizing device 100 can be referred to the foregoing embodiments. Since the electronic cigarette 1000 adopts all technical solutions described in the foregoing embodiments, it has at least all benefits brought by technical solutions of foregoing embodiments. The effects will not be repeated here.

The above is only the preferred embodiment of present disclosure, but not limit the patent scope of present disclosure. Any equivalent structural transformation that is under the inventive concept of present disclosure and made by using description and drawings of present disclosure, or directly/indirectly use such transformation in any other related technical fields are all covered by the patent protection scope of present disclosure.

What is claimed is:

1. An atomizing device of an electronic cigarette, the atomizing device comprising:

a nozzle cover; and a main body comprising a first part, a second part, and a third part, wherein the first part is covered by the nozzle cover, the second part is configured to be inserted into a power supply device of the electronic cigarette, and the third part is exposed outside when the main body is inserted into the power supply device, wherein the third part is further provided with at least one buckle part, wherein the main body is convexly provided with at least one limiting block on the second part, wherein when the main body is inserted into the power supply device, the limiting block will abut against the outer edge of the power supply device, and the surface of the limiting block facing away from the second part is exposed to form the third part.

2. The atomizing device of claim 1, wherein the outer surface of the limiting block protrudes beyond the outer surface of the power supply device to form the buckle part.

3. The atomizing device of claim 1, wherein the outer surface of the limiting block is lower than or flush with the outer surface of the power supply device, and the limiting block is provided with a groove abutted by inserted finger of user and forms the buckle part.

4. The atomizing device of claim 3, wherein the main body is provided with a chamber for storing tobacco juice, wherein the wall of the groove facing towards the notch is a transparent area, and the transparent area is used for a user to check the tobacco juice stored in the chamber.

5. The atomizing device of claim 1, wherein the power supply device is provided with an avoidance groove matching the side structure of the limiting block, wherein when the second end of the main body is inserted into the power supply device, the limiting block will locate third part the avoidance groove.

6. The atomizing device of claim 5, wherein one end of the limiting block away from the nozzle cover is an arc-shape, and the avoidance groove is in a corresponding arc-shape.

7. The atomizing device of claim 1, wherein the nozzle cover is provided with a notch matching the side structure of the limiting block, and the limiting block partially locate in the notch.

8. The atomizing device of claim 7, wherein one end of the limiting block facing towards the nozzle cover is an arc-shape, and the notch is in a corresponding arc-shape.

9. The atomizing device of claim 1, wherein two opposite ends of the nozzle cover are provided with connecting slots, and the main body is correspondingly provided with two connecting clips, wherein the nozzle cover can buckle-connects with the main body as well as cover the first part, wherein two opposite surfaces of the second part of the main body are convexly provided with the limiting blocks, and the two limiting blocks form the third part, wherein the two limiting blocks and the two connecting clips locate on each adjacent outer surface of the main body respectively.

10. The atomizing device of claim 9, wherein the main body includes a long axis and a short axis, wherein the two connecting clips are oppositely provided on the two outer surfaces of side main body along the direction of the long axis, and the two limiting blocks are oppositely provided on the two outer surfaces of side main body along the direction of the short axis.

11. An electronic cigarette comprising:

a power supply device; and an atomizing device that includes:

a nozzle cover; and a main body comprising a first part, a second part, and a third part, wherein the first part is covered by the nozzle cover, the second part is configured to be inserted into a power supply device of the electronic cigarette, and the third part is exposed outside when the main body is inserted into the power supply device, wherein the third part is further provided with at least one buckle part, wherein the main body is convexly provided with at least one limiting block on the second part, wherein when the main body is inserted into the power supply device, the limiting block will abut against the outer edge of the power supply device, and the surface of the limiting block facing away from the second part is exposed to form the third part.

12. An atomizing device of an electronic cigarette, the atomizing device comprising:

a nozzle cover; and a main body comprising a first part, a second part, and a third part, wherein the first part is covered by the nozzle cover, the second part is configured to be inserted into a power supply device of the electronic cigarette, and the third part is exposed outside when the main body is inserted into the power supply device, wherein the third part is further provided with at least one buckle part, wherein two opposite ends of the nozzle cover are provided with connecting slots, and the main body is correspondingly provided with two connecting clips, wherein the nozzle cover can buckle-connects with the main body as well as cover the first part, wherein two opposite surfaces of the second part of the main body are convexly provided with the limiting blocks, and the two limiting blocks form the third part, wherein the two limiting blocks and the two connecting clips locate on each adjacent outer surface of the main body respectively.

13. An electronic cigarette comprising:

a power supply device; and an atomizing device that includes:

a nozzle cover; and a main body comprising a first part, a second part, and a third part, wherein the first part is covered by the nozzle cover, the second part is configured to be inserted into a power supply device of the electronic cigarette, and the third part is exposed outside when the main body is inserted into the power supply device, wherein the third part is further provided with at least one buckle part, wherein two opposite ends of the nozzle cover are provided with connecting slots, and the main body is correspondingly provided with two connecting clips, wherein the nozzle cover can buckle-connects with the main body as well as cover the first part, wherein two opposite surfaces of the second part of the main body are convexly provided with the limiting blocks, and the two limiting blocks form the third part, wherein the two limiting blocks and the two connecting clips locate on each adjacent outer surface of the main body respectively.

* * * * *